US010502030B2

(12) United States Patent
Duphorne et al.

(10) Patent No.: US 10,502,030 B2
(45) Date of Patent: Dec. 10, 2019

(54) GRAVEL PACK SYSTEM WITH ALTERNATE FLOW PATH AND METHOD

(71) Applicants: Darin Henderson Duphorne, Houston, TX (US); Sean Gaudette, Katy, TX (US)

(72) Inventors: Darin Henderson Duphorne, Houston, TX (US); Sean Gaudette, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 411 days.

(21) Appl. No.: 15/001,352

(22) Filed: Jan. 20, 2016

(65) Prior Publication Data

US 2017/0204708 A1 Jul. 20, 2017

(51) Int. Cl.
*E21B 43/04* (2006.01)
*E21B 43/08* (2006.01)

(52) U.S. Cl.
CPC ..... *E21B 43/08* (2013.01); *E21B 43/04* (2013.01)

(58) Field of Classification Search
CPC ..... E21B 43/04; E21B 43/08
See application file for complete search history.

(56) References Cited

U.S. PATENT DOCUMENTS 4,917,183 A 4/1990 Gaidry et al.
5,476,143 A * 12/1995 Sparlin ..... E21B 43/088 166/233
5,515,915 A * 5/1996 Jones ..... E21B 43/045 166/227
6,053,250 A 4/2000 Echols
6,220,345 B1 * 4/2001 Jones ..... E21B 43/04 166/233
6,227,303 B1 * 5/2001 Jones ..... E21B 43/04 166/231
6,557,634 B2 * 5/2003 Hailey, Jr. ..... E21B 43/04 166/278
6,702,018 B2 * 3/2004 McGregor ..... E21B 43/04 166/227

(Continued)

FOREIGN PATENT DOCUMENTS

WO 2009088620 A2 7/2009

OTHER PUBLICATIONS

"Excellpak Multipath Gravel-Pack Screen—Overcome wellbore obstructions and simplify installation"; 2014 Baker Hughes Incorporated; bakerhughes.com; 2 pages.

(Continued)

*Primary Examiner* — Matthew R Buck
(74) *Attorney, Agent, or Firm* — Cantor Colburn LLP

(57) ABSTRACT

A gravel pack system includes a first tubular having a longitudinal axis and a first wall permitting radial fluidic movement, a second tubular surrounding the first tubular, the second tubular having a second wall permitting radial fluidic movement, and an open channel forming an alternate flow path and configured to flow slurry along the flow path relative to the longitudinal axis of the first tubular during a gravel pack operation, at least one side of the channel formed by a portion of at least one of the first and second walls. Fluidic communication between the channel and the first tubular in a radial direction is at least substantially blocked during the gravel pack operation.

25 Claims, 4 Drawing Sheets

(56) References Cited

U.S. PATENT DOCUMENTS 6,745,843 B2 * 6/2004 Johnson ..... E21B 17/10 166/205
6,789,624 B2 * 9/2004 McGregor ..... E21B 43/045 166/228
6,805,202 B2 * 10/2004 Gillespie ..... E21B 17/1035 166/378
6,848,510 B2 * 2/2005 Bixenman ..... E21B 43/04 166/227
6,863,131 B2 * 3/2005 Richard ..... E21B 17/1035 166/207
6,899,176 B2 * 5/2005 Hailey, Jr. ..... E21B 34/06 166/232
7,681,652 B2 3/2010 Gaudette et al.
7,717,178 B2 5/2010 Gaudette et al.
7,845,407 B2 * 12/2010 Bunnell ..... E21B 43/12 166/278
8,424,609 B2 4/2013 Duphorne et al.
9,133,705 B2 * 9/2015 Angeles Boza ..... E21B 43/08
9,151,143 B2 * 10/2015 Holderman ..... E21B 43/12
9,441,463 B2 * 9/2016 Cunningham ..... E21B 17/026
9,938,802 B2 * 4/2018 Sladic ..... E21B 43/08
2009/0133874 A1 * 5/2009 Dale ..... E21B 43/088 166/278
2010/0258301 A1 * 10/2010 Bonner ..... E21B 43/084 166/230
2011/0180271 A1 * 7/2011 Brekke ..... E21B 33/12 166/378
2015/0013980 A1 1/2015 Duphorne et al.
2015/0337623 A1 * 11/2015 Carrejo ..... E21B 34/063 166/373

OTHER PUBLICATIONS

"Torrent Openhole Gravel-Pack Solution—Ensure long-term sand control and profitable field development"; 2014 Baker Hughes Incorporated; bakerhughes.com; 8 pages.

* cited by examiner

GRAVEL PACK SYSTEM WITH ALTERNATE FLOW PATH AND METHOD

BACKGROUND

In the drilling and completion industry, the formation of boreholes for the purpose of production or injection of fluid is common. Hydrocarbons such as oil and gas can be recovered from the subterranean formation using the boreholes. In producing hydrocarbons or the like from loosely or unconsolidated and/or fractured formations, it is not uncommon to produce large volumes of particulate material along with the formation fluids. As is well known in the art, these particulates routinely cause a variety of problems and must be controlled in order for production to be economical. One technique used for controlling the production of particulates (e.g., sand) from a well is one that is commonly known as "gravel-packing."

In a typical gravel-packed completion, a screen is lowered into the wellbore on a work string and is positioned adjacent to the subterranean formation to be completed, e.g., a production formation. Particulate material, collectively referred to as "gravel," and a carrier fluid is then pumped as a slurry down the work string where it exits through a "cross-over" into the well annulus formed between the screen and the well casing or open hole, as the case may be. The liquid in the slurry normally flows into the formation and/or through the screen itself, which, in turn, is sized to prevent flow of gravel therethrough. This results in the gravel being deposited or "screened out" in the well annulus where it collects to form a gravel pack around the screen. The gravel, in turn, is sized so that it forms a permeable mass that allows the flow of the produced fluids therethrough and into the screen while blocking the flow of the particulates produced with the production fluids.

One major problem that occurs in gravel-packing single zones, particularly where they are long or inclined, arises from the difficulty in distributing the gravel over the entire completion interval, i.e., completely packing the entire length of the well annulus around the screen. This poor distribution of gravel (i.e., incomplete packing of the interval) is often caused by the carrier fluid in the gravel slurry being lost into the more permeable portions of the formation, which, in turn, causes the gravel to form "sand bridges" in the annulus before all the gravel has been placed.

Such bridges block further flow of slurry through the annulus, which prevents the placement of sufficient gravel below the bridge in top-to-bottom packing operations or above the bridge in bottom-to-top packing operations.

To address this specific problem, "alternate path" well strings have been developed which provide for distribution of gravel throughout the entire completion interval, even if sand bridges form before all the gravel has been placed. In these well screens, the alternate paths are formed by perforated shunts or bypass conduits and extend along the length of the screen and are in fluid communication with the gravel slurry as the slurry enters the well annulus around the screen. Such conduits may be placed on the outside of the screen with another shroud over the alternate paths to prevent them from being damaged during insertion or removal. If a sand bridge forms in the annulus, the slurry is still free to flow through the conduits and out into the annulus through the perforations in the conduits to complete the filling of the annulus above and/or below the sand bridge.

The art would be receptive to alternative and improved alternate path constructions and methods for a gravel packing operation.

BRIEF DESCRIPTION

A gravel pack system includes a first tubular having a longitudinal axis and a first wall permitting radial fluidic movement, a second tubular surrounding the first tubular, the second tubular having a second wall permitting radial fluidic movement, and an open channel forming an alternate flow path and configured to flow slurry along the flow path relative to the longitudinal axis of the first tubular during a gravel pack operation, at least one side of the channel formed by a portion of at least one of the first and second walls. Fluidic communication between the channel and the first tubular in a radial direction is at least substantially blocked during the gravel pack operation.

A method of operating downhole includes performing a gravel pack operation utilizing a channel as an alternate flow path for slurry; blocking movement of slurry fluid within the channel in an inwardly radial direction by an impermeable portion of the channel; at least partially degrading the impermeable portion of the channel to provide fluidic communication with a first tubular in an inwardly radial direction; and, producing production fluids through the channel and first tubular in the inwardly radial direction.

A gravel pack system includes an apertured outer shroud configured to surround a screen, the apertured outer shroud including a plurality of apertures, the apertured outer shroud further including at least one indent extending radially inwardly, the at least one indent forming a channel for an alternate flow path.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
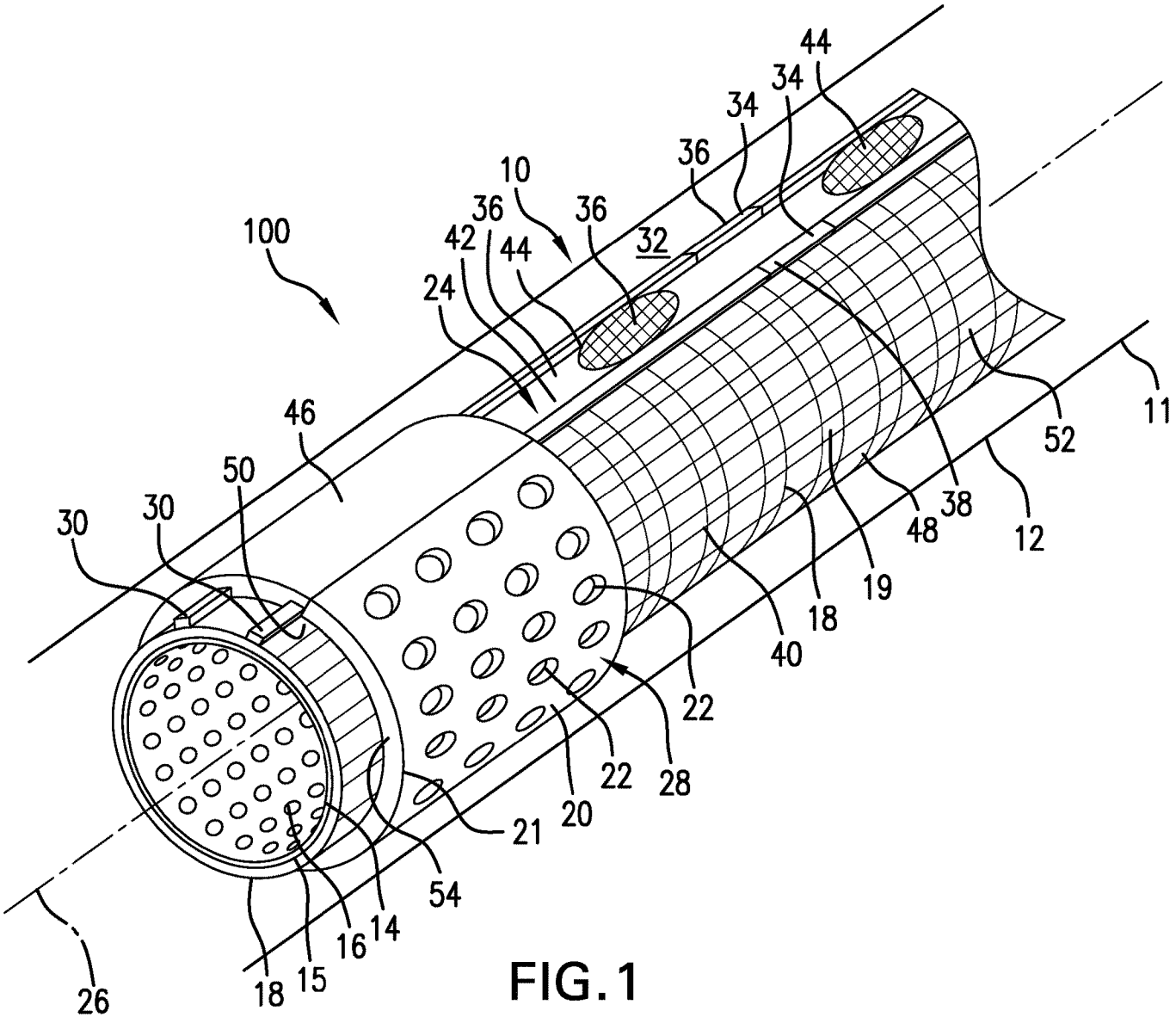
FIG. 1 depicts a perspective view of one embodiment of a portion of a completion system including a gravel pack system having one embodiment of an alternate flow path.

With reference now to FIG. 1, a portion of a completion system 100 is shown. The completion system 100 is usable, in some embodiments, to protect production integrity of a borehole wall 11 of a borehole 12 in a well by a tightly packed deposit of aggregate, such as sand, gravel or both, between the borehole wall 11 and a tubular, such as a production base pipe 14 having a wall 15. The completion system 100 is further usable for the purpose of production, injection, or both. The completion system 100 includes many components not specifically detailed herein, such as, but not limited to, packers, completion string, upper completion components, and downhole completion components. Portions of embodiments of a subterranean gravel pack system 10 within the completion system 100 are shown within the borehole 12, such as for a downhole well. The gravel pack system 10 includes the base pipe 14. The base pipe 14 is sized to deliver slurry 16 therethrough as well as sized to be subsequently used for production, such as by including any type of apertures, holes, slots, perforations, and openings through the wall 15. Radially exterior to the base pipe is a fluid permeable filter tubular 18 such as a screen. The tubular 18 has a wall 19 and may be any screen used in subterranean operations including, but not limited to, a wire wrap, screened metal, or other filter capable of restricting particulates of a certain size from passing there through. The gravel pack system 10 further includes an outer tubular 20, such as an outer shroud, to protect the tubular 18 during subterranean, such as downhole, operations. The outer tubular 20 has a wall 21 that includes apertures 22 dispersed about the tubular 20 so as to not block production fluids from passing through the tubular 20 and radially inward towards the tubular 18 and into the base pipe 14 after the gravel packing operation. For the purposes of these embodiments, apertures 22 include, but are not limited to, any type of holes, slots, perforations, and openings within the tubular 20 such that the tubular 20 forms a fluid permeable layer of the gravel pack system 10. In FIG. 1, the outer tubular 20 is only shown partially covering the tubular 18 so that the tubular 18 and channel 24 can be visible. It should be understood, however, that the outer tubular 20 extends substantially the same longitudinal length as the tubular 18, for the protection of the tubular 18. The base pipe 14, tubular 18, and outer tubular 20 may substantially share longitudinal axis 26. Although not shown, an inner tubular, such as an inner shroud, may be provided between the tubular 18 and the base pipe 14.

The channel 24 in the gravel pack system of FIG. 1 is radially disposed between the outer tubular 20 and the tubular 18. A cartridge assembly 28 may include the outer tubular 20 (such as an outer shroud), filter tubular 18 (such as a screen), channel 24, and inner tubular (such as an inner shroud), such that the cartridge assembly 28 can then be modularly installed on the tubular base pipe 14. The channel 24 may be formed by securing at least two rods 30 to the tubular 18, the outer tubular 20, or both, such as by welding (spot-welding in select locations or longitudinal welding along the length of the rods 30), clipping, or otherwise affixing, to define an alternate flow path 32 there between. Additional rods 30 may be secured to the tubular 18, tubular 20, or both to form additional channels 24 with alternate flow paths 32. The rods 30 may extend longitudinally, and substantially parallel to the longitudinal axis 26, however the rods may be arranged in alternate patterns between the tubular 18 and outer tubular 20. The rods 30 define annular walls of the channel 24. The rods 30 can be metallic, or optionally be made wholly or partially from a degradable polymer or other material suitable to resist erosion during the gravel packing operation. During a gravel pack operation, the rods 30 prevent circumferential travel of the slurry 16 and restrict the slurry 16 to the alternate flow path 32 between the rods 30 of the channel 24. Thus, the channel 24 is formed and radially bound by the tubular 20 and tubular 18, and circumferentially bound by the rods 18, eliminating the need to provide a separate slurry transport tube. In alternate embodiments, the channel 24 may be formed by the rods 30 and any combination of an inner tubular and an outer tubular of the gravel pack system 10. For example, the channel 24 may be formed by the rods 30 disposed between a screen and a shroud, between a shroud and a base pipe, between a screen and a base pipe, between an inner shroud and an outer shroud, or between any other combination of inner and outer tubulars of a gravel pack system 10. The inner and outer tubulars each include a wall that permits radial fluidic movement through any one or combination of apertures, slots, openings, perforations, and holes formed in each wall of the inner and outer tubulars. For illustrative purposes only, the channel 24 is described in one embodiment as formed between an inner screened tubular 18 and an outer shroud tubular 20. Three or more rods 30 may be provided when more than two channels 24 are desired, and circumferential travel of the slurry 16 between adjacent channels 24 can be restricted by the rods 30. In some embodiments, sections 34 of the rods 30 or the entire rods 30, include a degradable material 36 that partially degrades or completely dissolves after the gravel pack operation to form an opening 38 to fluidically communicate the alternate flow path 32 with an adjacent space 40 (such as the annulus between the outer tubular 20 and the tubular 18), such that during production, a greater surface area of the tubular 18 is usable for production. The degradable material 36 may include, but is not limited to, a degradable polymer such as a polyvinyl alcohol degradable polymer. Alternatively, but not with limitation, the degradable material 36 may include a controlled electrolytic metallic (CEM) nanostructured material available from Baker Hughes, the material employed in Baker Hughes IN-Tallic™ disintegrating frac balls. The CEM nanostructured material is lighter than aluminum and stronger than some mild steels, but disintegrates when it is exposed to the appropriate fluid. The disintegration process works through electrochemical reactions that are controlled by nanoscale coatings within the composite grain structure.

During the gravel pack operation, in order for slurry 16 to travel along the alternate flow path 32 without radially losing fluid from the slurry 16 through the tubular 18, the channel 24 may further include a fluidically impermeable layer 42 disposed between the tubular 18 and the alternate flow path 32. The layer 42 may, in one embodiment, be temporarily fluidically impermeable and include a degradable material 36 that may be substantially or entirely degradable so that production fluids may be allowed to pass from the channel 24 and radially into the tubular 18 and base pipe 14 during production. A degradable polymer material that is sufficiently resistant to erosion provides a suitable channel surface, though other degradable materials 36 could be used. In one embodiment, the degradable material 36 may cover the tubular 18 along substantially an entire length of the channel 24. For example, a polyvinyl alcohol degradable polymer may be formed in a film to cover substantially an entire area defined between the rods 30 of the channel 24. In another embodiment, the layer 42 may be fluid impermeable and non-degradable, and the degradable material 36 may be isolated as inserts 44 within the fluidically impermeable layer 42, such as when a non-degradable material is used as the fluidically impermeable layer, and optional sand control inserts 44 are initially plugged with degradable material 36 and provided at desired intervals along the channel 24 to cover the tubular 18. The degradable material 36 for the inserts may include, but is not limited to, a degradable polymer, or alternatively may include controlled electrolytic metallic (CEM) nanostructured material. Other degradable materials 36 suitable for maintaining fluid impermeability during a gravel packing operation and subsequent degradation before or during a production operation may also be employed. In yet another embodiment, the layer 42 may be fluid impermeable and non-degradable yet not be provided with degradable inserts. In still another embodiment, the layer 42 may be integral with the tubular 18 such as by providing a fluid impermeable section of the tubular 18 along the channel 24. In still yet another embodiment, the layer 42 may be fluid impermeable and non-degradable, but access to fluid permeable portions of the tubular 18 may be had through the openings 38 between the rods 30 upon degradation of the sections 34.

Also during the gravel pack operation, in order for slurry 16 to travel along the alternate flow path 32 without losing fluid from the slurry 16 through the outer tubular 20, the outer tubular 20 includes a fluid impermeable section 46 along substantially an entire length and width of the channel 24. Although not shown, the fluid impermeable section 46 may be interrupted by one or more emitters disposed along the length of the channel 24 to allow for the slurry 16 carried through the channel 24 to be selectively deposited within the annulus 48 between the gravel pack system 10 and the wall of the 12. The fluid impermeable section 46 may be obtained by simply not providing apertures within that section 46 of the outer tubular 20. Alternatively, the fluid impermeable section 46 may include apertures 22 which are filled or covered with degradable material 36. For example, the apertures 22 may be filled with a degradable material 36 such as the degradable inserts 44, or the area of the impermeable section 46 may be made fluid impermeable by applying a degradable impermeable layer 42 on the section 46 to form one side of the channel 24 for the alternate flow path 32. In such an embodiment, the fluid impermeable section 46 is fluid permeable during a production phase, thus increasing an overall production surface area for the system 10.

Figure 2:
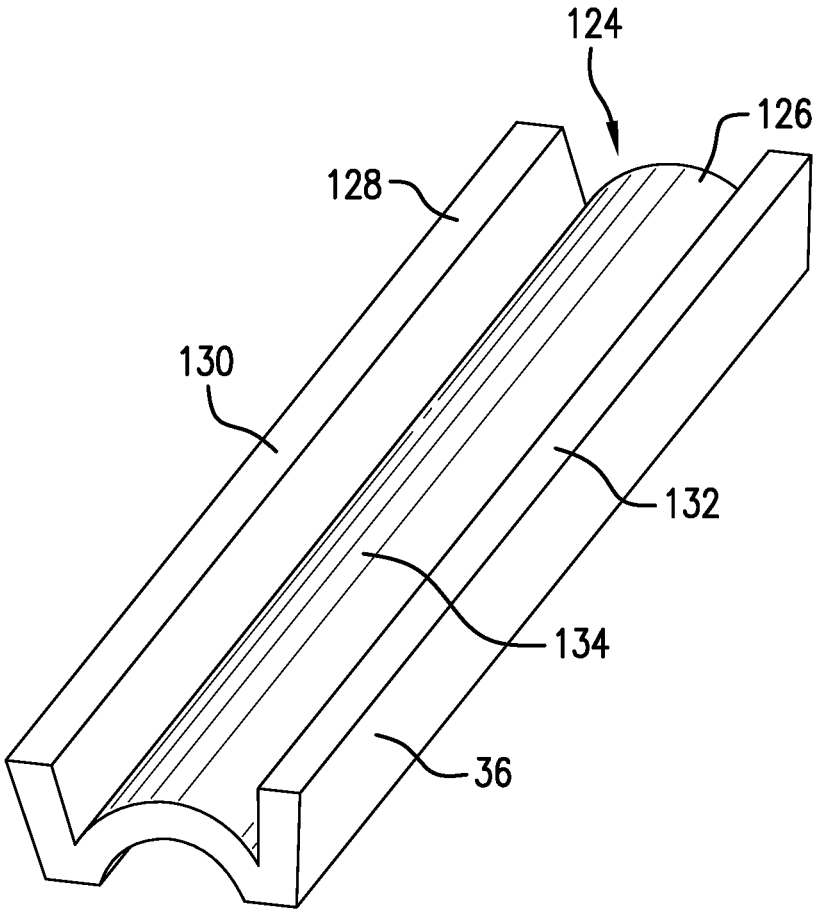
FIG. 2 depicts a perspective view of one embodiment of a channel insert for an alternate flow path of the gravel pack system of FIG. 1.

With additional reference to FIG. 2, an alternate embodiment of a channel 124 is shown. In lieu of discrete rods 30 and layer 42, a channel body 126 could be inserted between the impermeable section 46 of the outer tubular 20 and the tubular 18 to provide the channel 124. The channel 124 may replace the rods 30 and the layer 42 shown in FIG. 1 with the channel insert 128. The channel insert 128 includes first and second longitudinally extending walls 130, 132 sized to radially span a gap 50 (FIG. 1) between the outer surface 52 of the tubular 18 and inner surface 54 of the shroud. The channel insert 128 further includes an intermediate section 134 extending between the first and second walls 130, 132. The intermediate section 134 may have a radius of curvature sized to complement the radius of curvature of the tubular 18. In one embodiment, the channel insert 128 may be formed partially or entirely of a degradable material 36 as previously described. For example, a polyvinyl alcohol degradable polymer may be extruded into the generally U-shaped channel insert 128 shown in FIG. 2. In another embodiment, the channel body 126 may not be degradable. In yet another embodiment, the channel body 126 is not degradable, but the channel insert 128 includes the inserts 44 (FIG. 1) made of degradable material 36 positioned along one or more selected areas of the channel insert 128. Thus, the channel 124 formed by the channel insert 128 and the impermeable section 46 of the outer tubular 20 is capable of providing the alternate flow path 32 during the gravel pack operation. Further, in some embodiments, since the channel insert 128 may be degradable or include inserts 44 that are degradable, production fluids are radially movable into the tubular 18 through the area of the alternate flow path 32 once the channel insert 128 or inserts 44 are degraded or dissolved. Alternatively, the channel insert 128 may be formed such that an impermeable section 42 of the tubular 18 forms one side of the channel 24, while the insert 128 forms the other sides of the channel 24.

Figure 3:
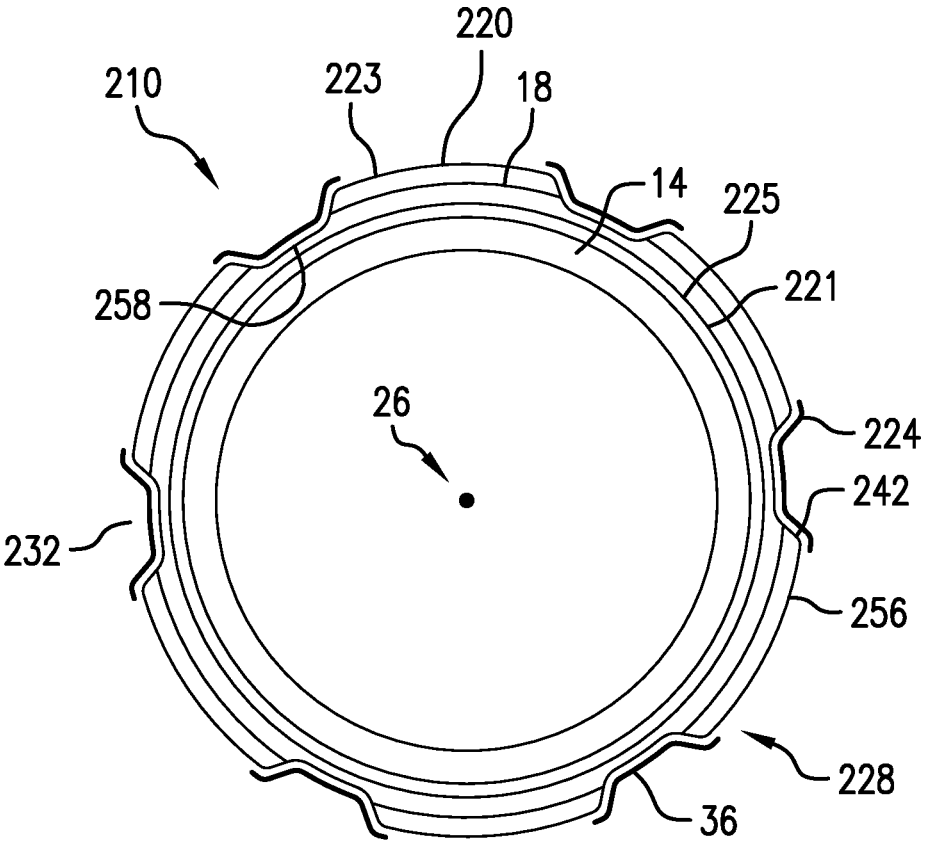
FIG. 3 depicts a cross-sectional view of another embodiment of a gravel pack system having one embodiment of an alternate flow path; and, FIG. 4 depicts a perspective view of another embodiment of a gravel pack system having one embodiment of an alternate flow path; and, FIG. 5 depicts a schematic view of a section of the gravel pack system of FIG. 4 prior to assembly.

With reference now to FIG. 3, another embodiment of a gravel pack system 210 is shown. The gravel pack system 210 includes the base pipe 14, tubular 18 (such as a screen), and an outer tubular 220, such as, but not limited to, an outer shroud. An inner tubular 221, such as, but not limited to an inner shroud, between the base pipe 14 and the tubular 18 may further be provided. The tubulars 220 and 221 each include walls 223 and 225, respectively, which permit radial fluidic movement therethrough due to any one or a combination of apertures, slots, openings, perforations, and holes formed in each wall. In this embodiment, the channel 224 for the alternate flow path 232 is disposed exteriorly of an outer surface 256 of the outer tubular 220. The outer tubular 220 is indented at indent 258 to form the channel 224, and thus the channel 224 is integrally formed within the tubular 220. The indent 258 may be formed during swaging of the outer tubular 220 to the inner tubular 221. That is, when the outer tubular 220 is swaged down to the inner tubular 221, the swaging process is performed unevenly across a perimeter of the outer tubular 220. That is, the gravel pack system 210 is swaged down to create the indents 258. As illustrated, the indent 258 protrudes radially inwardly towards the tubular 18 and inner tubular 221. The channel 224 forms an alternate path 232 for a gravel pack operation. As in the previous embodiments, a cartridge assembly 228 includes at least the outer tubular 220, channel 224, and tubular 18, and further includes the inner tubular 221 for interior protection of the tubular 18. As the outer tubular 220 is apertured, to prevent fluid from the slurry 16 from radially exiting the alternate path 232 towards the tubular 18, the indents 258 are lined with a fluidically impermeable layer 242, that may, in some embodiments, be temporarily fluidically impermeable by being made of, or at least partially of, a degradable material 36. In such an embodiment, at the conclusion of a gravel pack operation, prior to production, or during production, the degradable material 36 degrades, and may completely dissolve, so that the radial apertures 22 (see FIG. 1) in the tubular 220 within the channel 224 become exposed and the area for production fluids to reach the tubular 18 is increased. A plurality of channels 224 can be included in the gravel pack system 210. Since the impermeable layer 242 may be degradable, production is not limited by the number of channels 224 utilized.

Figure 4:
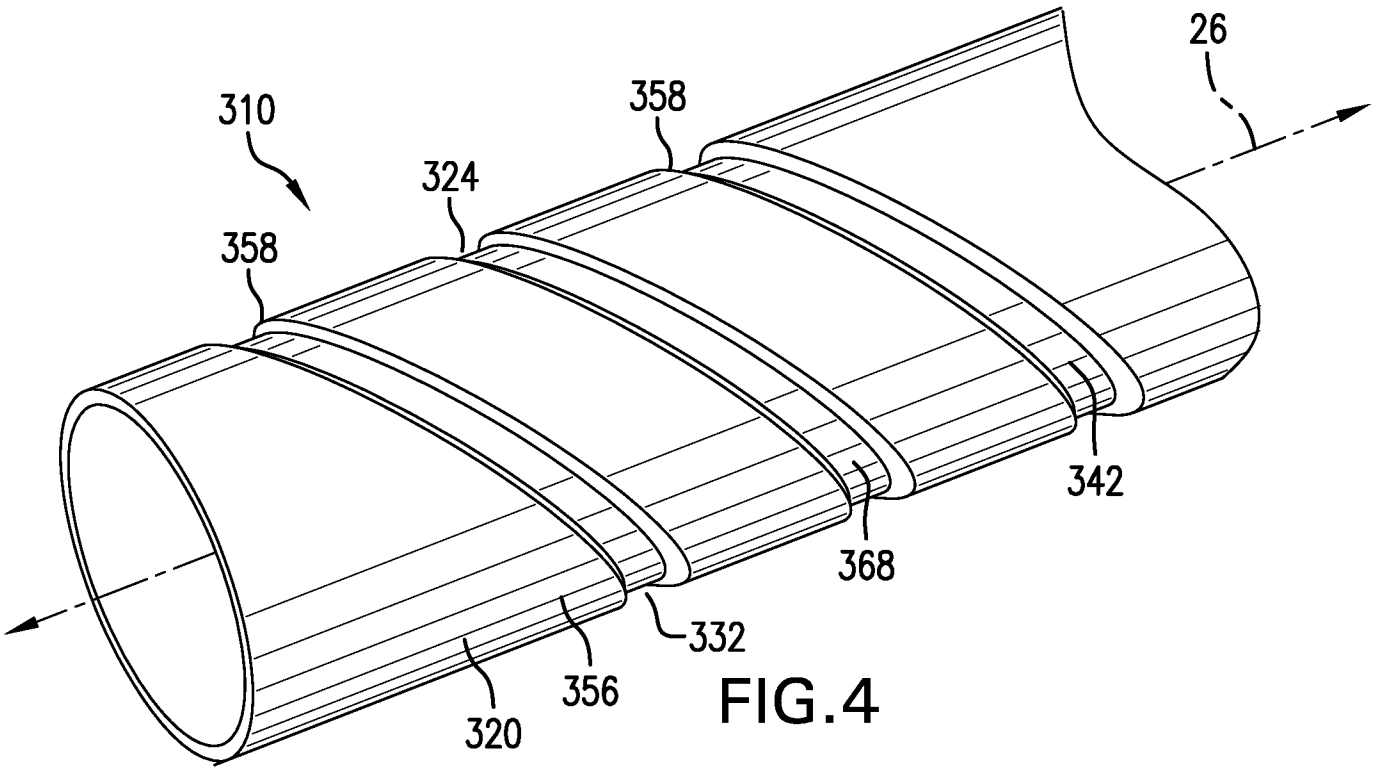
Figure 5:
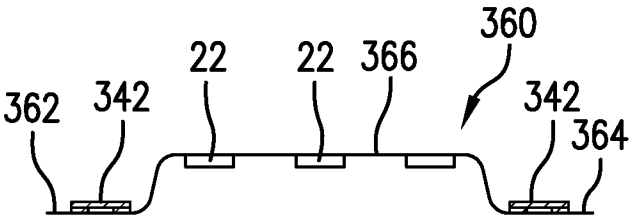

The channels 224 of the gravel pack system 210 of FIG. 3 may extend longitudinally, and substantially parallel with the longitudinal axis 26 of the tubular 18, as in the gravel pack system 10 of FIG. 1. Alternatively, as shown in FIG. 4, channels 324 may extend helically about the longitudinal axis 26. Similar to FIG. 3, the channels 324 are disposed radially exterior of the outer shroud 320 and include indents 358 that may be lined with an impermeable layer 342. To form the helical channels 324 in the outer shroud 320, and with additional reference to FIG. 5, the shroud 320 is formed from a strip or strips 360 of flat rolled stock. The strips 360 are run through a machine that punches the apertures 22 into the strips 360. The edges 362, 364 of the strip 360 are indented from a main portion 366 of the strip 360. The edges 362, 364 may be indented during a same or subsequent process while the apertures 22 are being punched into the strip 360. The resultant strip 360 is then, as shown in FIG. 5, non-planar with the edges 362, 364 being offset from the main portion 366. The outer shroud 320 is then formed by spiral welding the offset edges 362, 364 of the strip 360 together. That is, the first edge 362 is welded to the second edge 364 to form the tubular outer shroud 320. The weld 368 forms a central portion of the indent 358 of the channel 324. The channel 324 may then be lined with the impermeable layer 342, or alternatively the indented edges 362, 364 each include a portion of the impermeable layer 342 prior to welding. Alternatively, the edges 362, 364 that form the indent 358 may simply be left un-perforated such that the helical channel 324 is permanently fluid impermeable. In either case, the result is a helical channel 324 on the exterior surface 356 of the shroud 320 that can serve as an alternate flow path 332 for the gravel pack system 310 during a gravel pack operation. During the gravel pack operation, since fluid from slurry 16 is blocked from entering the tubular 18 at the area of the channel 324, fluid will continue to flow along the channel 324 and thus gravel and sand within the channel 324 will continue to move. In some embodiments, the impermeable layer 342 may be wholly or partially degradable, and after the impermeable layer 342 degrades or dissolves, the apertures 22 in the shroud 320 allow access for production fluids to reach the tubular 18 through the indents 358 as well as the non-channeled areas (main portion 366) of the shroud 320.

The embodiments of a gravel pack system 10, 210, 310 disclosed herein eliminate separate slurry delivery tubes completely as compared to conventional gravel pack systems having slurry tubes for alternate flow paths. By eliminating slurry delivery tubes and utilizing inner and/or outer tubulars of the gravel pack systems 10, 210, 310 as a wall or walls of the channels, an increase in cross-sectional area of the flow path 32 may be obtained, and cost benefits may be realized by eliminating the slurry tubes. Further, embodiments of the gravel pack system 10, 210, 310 reclaim production flow area otherwise occupied by the tubes. In lieu of slurry delivery tubes, in some embodiments, a channel is formed between an impermeable longitudinal section of the shroud and a corresponding longitudinal section of the tubular 18. To facilitate gravel packing operations in the channel during gravel pack operations, the screen section along the channel length and width is covered, coated or otherwise treated to prevent fluid flow through the screen. In some embodiments, this layer or other treatment will degrade after gravel packing, such as during production, to provide additional production flow area through the channel area, and at least periodic sections of the rods 30 may also be degradable to permit circumferential flow in the annulus between the shroud and the screen during production. Channel inserts 128 may alternatively be provided. A single conventional tube may still be desired to provide one or more suitable exit ports for each screen section. However, shroud openings along the channel alone may suffice. In other embodiments, channels are formed into the outer shroud during manufacture and used to assemble cartridge assemblies. Formed channels can be lined with a impermeable material for flow assurance during gravel packing operation and may further be dissolvable/degradable to increase production area during production. Also, helical flow channels can be formed during manufacture of the outer shroud of the cartridge assemblies.

Shroud design may need to be reinforced to support flow rate burst pressures; however, channel number and sizing can be adjusted to reduce this pressure considerably. In embodiments utilizing degradable material, when the material is reliably degradable, virtually the entire screen OD could be used for slurry delivery, reducing the burst pressures considerably. The embodiments of a gravel pack system 10, 210, 310 thus save cost and manufacturing requirements of slurry transport tubes while increasing production flow area through the tubular 18.

Embodiment 1: A gravel pack system includes a first tubular having a longitudinal axis and a first wall permitting radial fluidic movement, a second tubular surrounding the first tubular, the second tubular having a second wall permitting radial fluidic movement, and an open channel forming an alternate flow path and configured to flow slurry along the flow path relative to the longitudinal axis of the first tubular during a gravel pack operation, at least one side of the channel formed by a portion of at least one of the first and second walls. Fluidic communication between the channel and the first tubular in a radial direction is at least substantially blocked during the gravel pack operation.

Embodiment 2: The gravel pack system of embodiment 1, wherein the channel is formed between the first tubular and the second tubular.

Embodiment 3: The gravel pack system of embodiment 2, wherein the channel includes two circumferentially spaced rods extending longitudinally between the first and second tubulars.

Embodiment 4: The gravel pack system of embodiment 3, further comprising a degradable material disposed between the rods.

Embodiment 5: The gravel pack system of embodiment 3, wherein a portion of at least one of the rods includes a degradable material.

Embodiment 6: The gravel pack system of embodiment 2, wherein the channel includes a degradable polymer channel insert disposed between the first and second tubulars, the insert including first and second longitudinally extending walls and an intermediate section connecting the first and second longitudinally extending walls.

Embodiment 7: The gravel pack system of embodiment 2, wherein the second tubular includes a fluid impermeable section extending along substantially an entire length and width of the channel.

Embodiment 8: The gravel pack system of embodiment 1, wherein the channel is disposed on an outer surface of the second tubular.

Embodiment 9: The gravel pack system of embodiment 1, wherein the channel is an indent formed along a surface of the second tubular.

Embodiment 10: The gravel pack system of embodiment 9, wherein the indent extends helically about the longitudinal axis.

Embodiment 11: The gravel pack system of embodiment 10, wherein the second tubular is formed from a non-planar strip having edges offset from a main portion, and the strip is spiral welded along a helical line to join the edges and form the indent.

Embodiment 12: The gravel pack system of embodiment 9, wherein the indent extends substantially parallel to the longitudinal axis.

Embodiment 13: The gravel pack system of embodiment 9, wherein a cross-section of the indent extends radially inward towards the first tubular.

Embodiment 14: The gravel pack system of embodiment 9, further comprising a degradable material disposed within the indent.

Embodiment 15: The gravel pack system of embodiment 1, wherein at least a section of the channel is formed of a degradable material, and fluidic communication between the channel and the first tubular is at least substantially blocked in a radial direction in a non-degraded condition of the degradable material, and fluidic communication between the channel and the first tubular in a radial direction is permitted in a degraded condition of the degradable material.

Embodiment 16: The gravel pack system of embodiment 15, wherein the degradable material includes a polymeric material.

Embodiment 17: The gravel pack system of embodiment 15, wherein the degradable material includes a controlled electrolytic metallic nanostructured material.

Embodiment 18: A completion system including the gravel pack system of embodiment 1, the completion system further comprising a third tubular disposed within the first tubular, wherein the first tubular is a screen, the second tubular is a shroud, and the third tubular is a base pipe.

Embodiment 19: A method of operating downhole, the method comprising: performing a gravel pack operation utilizing the gravel pack system of embodiment 1 and delivering slurry through the channel.

Embodiment 20: A method of operating downhole, the method comprising: performing a gravel pack operation utilizing a channel as an alternate flow path for slurry; blocking movement of slurry fluid within the channel in an inwardly radial direction by an impermeable portion of the channel; at least partially degrading the impermeable portion of the channel to provide fluidic communication with a first tubular in an inwardly radial direction; and, producing production fluids through the channel and first tubular in the inwardly radial direction.

Embodiment 21: The method of embodiment 20, wherein at least partially degrading the impermeable portion of the channel includes at least partially degrading a degradable material disposed on the screen.

Embodiment 22: The method of embodiment 20, wherein at least partially degrading the impermeable portion of the channel includes at least partially degrading a degradable material disposed on a shroud surrounding the screen.

Embodiment 23: The method of embodiment 20, wherein at least partially degrading the impermeable portion of the channel includes at least partially degrading a degradable material of the channel during a production operation.

Embodiment 24: A gravel pack system includes an apertured outer shroud configured to surround a screen, the apertured outer shroud including a plurality of apertures, the apertured outer shroud further including at least one indent extending radially inwardly, the at least one indent forming a channel for an alternate flow path.

Embodiment 25: The gravel pack system of embodiment 24 wherein the at least one indent extends along a spiral weld of the outer shroud.

Embodiment 26: The gravel pack system of embodiment 24 further comprising the screen and an inner shroud, wherein the indent is formed on the outer shroud during a swaging process of the outer shroud, screen, and inner shroud to form a cartridge assembly.

Embodiment 27: The gravel pack system of embodiment 24, further comprising a degradable material disposed within the at least one indent.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A gravel pack system comprising:

a first tubular having a longitudinal axis and a first wall permitting radial fluidic movement;

a second tubular surrounding the first tubular, the second tubular having a second wall permitting radial fluidic movement; and, an open channel forming an alternate flow path and configured to flow slurry along the flow path relative to the longitudinal axis of the first tubular during a gravel pack operation, at least one side of the channel formed by a portion of at least one of the first and second walls, and the channel being formed between the first tubular and the second tubular;

wherein fluidic communication between the channel and the first tubular in a radial direction is at least substantially blocked during the gravel pack operation, and at least a section of the channel being formed of a degradable material, and fluidic communication between the channel and the first tubular being at least substantially blocked in the radial direction in a non-degraded condition of the degradable material, and fluidic communication between the channel and the first tubular in the radial direction being permitted in a degraded condition of the degradable material.

2. The gravel pack system of claim 1, wherein the channel includes two circumferentially spaced rods extending longitudinally between the first and second tubulars.

3. The gravel pack system of claim 2, wherein the degradable material is disposed between the rods.

4. The gravel pack system of claim 2, wherein a portion of at least one of the rods includes the degradable material.

5. The gravel pack system of claim 1, wherein the channel includes a degradable polymer channel insert disposed between the first and second tubulars, the insert including first and second longitudinally extending walls and an intermediate section connecting the first and second longitudinally extending walls.

6. The gravel pack system of claim 1, wherein the second tubular includes a fluid impermeable section extending along substantially an entire length and width of the channel.

7. The gravel pack system of claim 1, wherein the degradable material includes a polymeric material.

8. The gravel pack system of claim 1, wherein the degradable material includes a controlled electrolytic metallic nanostructured material.

9. A completion system including the gravel pack system of claim 1, the completion system further comprising a third tubular disposed within the first tubular, wherein the first tubular is a screen, the second tubular is a shroud, and the third tubular is a base pipe.

10. A method of operating downhole using the gravel pack system of claim 1, the method comprising:

performing a gravel pack operation utilizing the channel as the alternate flow path for slurry;

blocking movement of slurry fluid within the channel in an inwardly radial direction by an impermeable portion of the channel;

at least partially degrading the impermeable portion of the channel to provide fluidic communication with the first tubular in the inwardly radial direction; and, producing production fluids through the channel and first tubular in the inwardly radial direction.

11. The method of claim 10, wherein at least partially degrading the impermeable portion of the channel includes at least partially degrading the degradable material, the degradable material disposed on the first tubular.

12. The method of claim 10, wherein at least partially degrading the impermeable portion of the channel includes at least partially degrading the degradable material of the channel during a production operation.

13. A gravel pack system comprising:

an apertured outer shroud configured to surround a screen, the apertured outer shroud including a plurality of apertures, the apertured outer shroud further including at least one indent having a side surface and a base surface including at least one opening extending radially inwardly, the at least one indent forming a channel for an alternate flow path; and, a degradable material disposed within the at least one indent, the degradable material extending along the channel on the base surface covering the at least one opening;

wherein the channel is disposed on an outer surface of the outer shroud.

14. The gravel pack system of claim 13 wherein the at least one indent extends along a spiral weld of the outer shroud.

15. A gravel pack system comprising:

a first tubular having a longitudinal axis and a first wall permitting radial fluidic movement;

a second tubular surrounding the first tubular, the second tubular having a second wall permitting radial fluidic movement; and, an open channel forming an alternate flow path and configured to flow slurry along the flow path relative to the longitudinal axis of the first tubular during a gravel pack operation, at least one side of the channel formed by a portion of at least one of the first and second walls, and the channel being an indent formed along a surface of the second tubular;

wherein fluidic communication between the channel and the first tubular in a radial direction is at least substantially blocked during the gravel pack operation, and at least a section of the channel is formed of a degradable material, and fluidic communication between the channel and the first tubular being at least substantially blocked in the radial direction in a non-degraded condition of the degradable material, and fluidic communication between the channel and the first tubular in the radial direction being permitted in a degraded condition of the degradable material.

16. The gravel pack system of claim 15, wherein the indent extends helically about the longitudinal axis.

17. The gravel pack system of claim 16, wherein the second tubular is formed from a non-planar strip having edges offset from a main portion, and the strip is spiral welded along a helical line to join the edges and form the indent.

18. The gravel pack system of claim 15, wherein the indent extends substantially parallel to the longitudinal axis.

19. The gravel pack system of claim 15, wherein a cross-section of the indent extends radially inward towards the first tubular.

20. The gravel pack system of claim 15 wherein the degradable material is disposed within the indent.

21. The gravel pack system of claim 15, wherein the second tubular is an outermost tubular of the gravel pack system.

22. A gravel pack system comprising:

a screen;

an apertured outer shroud configured to surround the screen, the apertured outer shroud including a plurality of apertures, the apertured outer shroud further including at least one indent extending radially inwardly, the at least one indent forming a channel for an alternate flow path, wherein the channel is configured to flow slurry along the flow path during a gravel pack operation; and, a degradable material disposed within the at least one indent;

wherein fluidic communication between the channel and the screen in a radial direction is at least substantially blocked during the gravel pack operation and in a non-degraded condition of the degradable material, and fluidic communication between the channel and the screen in the radial direction is permitted in a degraded condition of the degradable material.

23. The gravel pack system of claim 22 further comprising an inner shroud, wherein the indent is formed on the outer shroud during a swaging process of the outer shroud, screen, and inner shroud to form a cartridge assembly.

24. A method of operating downhole, the method comprising:

performing the gravel pack operation utilizing the gravel pack system of claim 22; and delivering slurry through the channel.

25. The method of claim 24, further comprising at least partially degrading the degradable material to provide fluidic communication with the screen in an inwardly radial direction, and producing production fluids through the channel in the inwardly radial direction.

* * * * *